US008663136B1

(12) United States Patent
Alsaffar

(10) Patent No.: US 8,663,136 B1
(45) Date of Patent: Mar. 4, 2014

(54) WHEELED SUPPORT ASSEMBLY FOR THE DISABLED

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 6 days.

(21) Appl. No.: 13/762,263

(22) Filed: Feb. 7, 2013

(51) Int. Cl.
*A61H 3/00* (2006.01)

(52) U.S. Cl.
USPC ..... 601/35; 135/67; 482/69

(58) Field of Classification Search
USPC ..... 601/5, 23, 24, 33, 34, 35; 280/87.021, 280/87.05, 87.051; 482/52, 67, 68, 69, 78, 482/142; 135/66, 67, 84, 85, 912; 297/5
See application file for complete search history.

(56) References Cited

U.S. PATENT DOCUMENTS

| | | | | |
|---|---|---|---|---|
| 4,188,966 | A * | 2/1980 | Palmer et al. | 135/67 |
| 5,174,590 | A | 12/1992 | Kerley et al. | |
| 5,275,426 | A | 1/1994 | Tankersley | |
| 5,588,456 | A * | 12/1996 | Hart | 135/67 |
| 6,578,594 | B1 * | 6/2003 | Bowen et al. | 135/67 |
| 2001/0048206 | A1 * | 12/2001 | Niu et al. | 280/87.021 |
| 2010/0170546 | A1 * | 7/2010 | Popovic et al. | 135/67 |
| 2011/0066088 | A1 | 3/2011 | Little et al. | |

* cited by examiner

*Primary Examiner* — Quang D Thanh
(74) *Attorney, Agent, or Firm* — Richard C. Litman

(57) ABSTRACT

The wheeled support assembly for the disabled is an assembly designed to assist a disabled person to walk steadily. The assembly includes a wheeled frame having a detachable body harness. The body harness is adapted to fit around the torso of the disabled person and to provide back support therefor. The body harness includes a pair of articulated columns for removable attachment to the disabled person's legs. The lower end of each column terminates in a foot member, wherein the disabled person may insert his/her feet. When attached to the wheeled frame, the harness stabilizes the disabled person's body within the frame such that movement of the legs will propel the entire assembly. The assembly also includes rubber handles, an alarm clock and an audible emergency alert device.

4 Claims, 3 Drawing Sheets

WHEELED SUPPORT ASSEMBLY FOR THE DISABLED

BACKGROUND OF THE INVENTION

1. Field of the Invention

The present invention generally relates to medical appliances, and particularly to a wheeled support assembly for the disabled that provides an appliance designed to assist the disabled to walk without assistance from an escort.

2. Description of the Related Art

Because of the strides made in eradicating and curing disease, recent studies predict that one of the major challenges facing the medical community will be that of physical disability. In the future, an aging population will rely heavily on assistance to perform even limited basic functions, such as walking. There is a plethora of specialized canes, crutches and mechanized carts being offered in the market today to provide mobility assistance for the disabled. However, these devices are primarily concerned with either leg or back disablement problems and do not consider a patient who may be afflicted with both of the aforementioned disablements. The medical art would certainly embrace an assembly designed to assist such a disabled patient to walk safely and steadily without assistance from an escort. Thus, a wheeled support assembly for the disabled solving the aforementioned problems is desired.

SUMMARY OF THE INVENTION

The wheeled support assembly for the disabled is an assembly designed to assist a disabled person to walk steadily. The assembly comprises a wheeled frame having a body harness detachable thereto. The body harness is adapted to fit around the torso of the disabled person and to provide back support therefor. The body harness includes a pair of articulated columns for removable attachment to the disabled person's legs. The lower end of each column terminates in a foot member, wherein the disabled person may insert his/her feet. When attached to the wheeled frame, the harness stabilizes the disabled person's body within the frame such that movement of the legs will propel the entire assembly. The assembly also includes rubber handles, an alarm clock, and an audible emergency alert device.

Accordingly, the invention presents a medical appliance that effectively enhances the mobility of a person having leg and back disablement problems. In use, the appliance is safe, efficient and provides more than adequate support for the disabled person. The invention provides for improved elements thereof in an arrangement for the purposes described that are inexpensive, dependable and fully effective in accomplishing their intended purposes.

These and other features of the present invention will become readily apparent upon further review of the following specification and drawings.

DETAILED DESCRIPTION OF THE PREFERRED EMBODIMENTS

Figure 1:
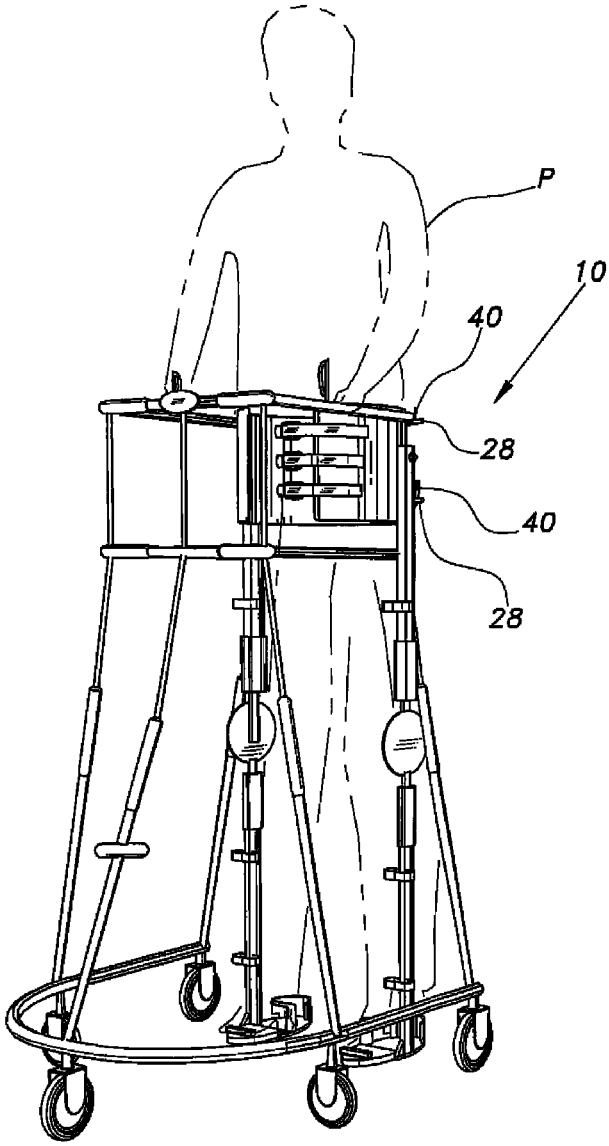
FIG. 1 is an environmental, perspective view of a wheeled support assembly for the disabled according to the present invention.
Figure 2:
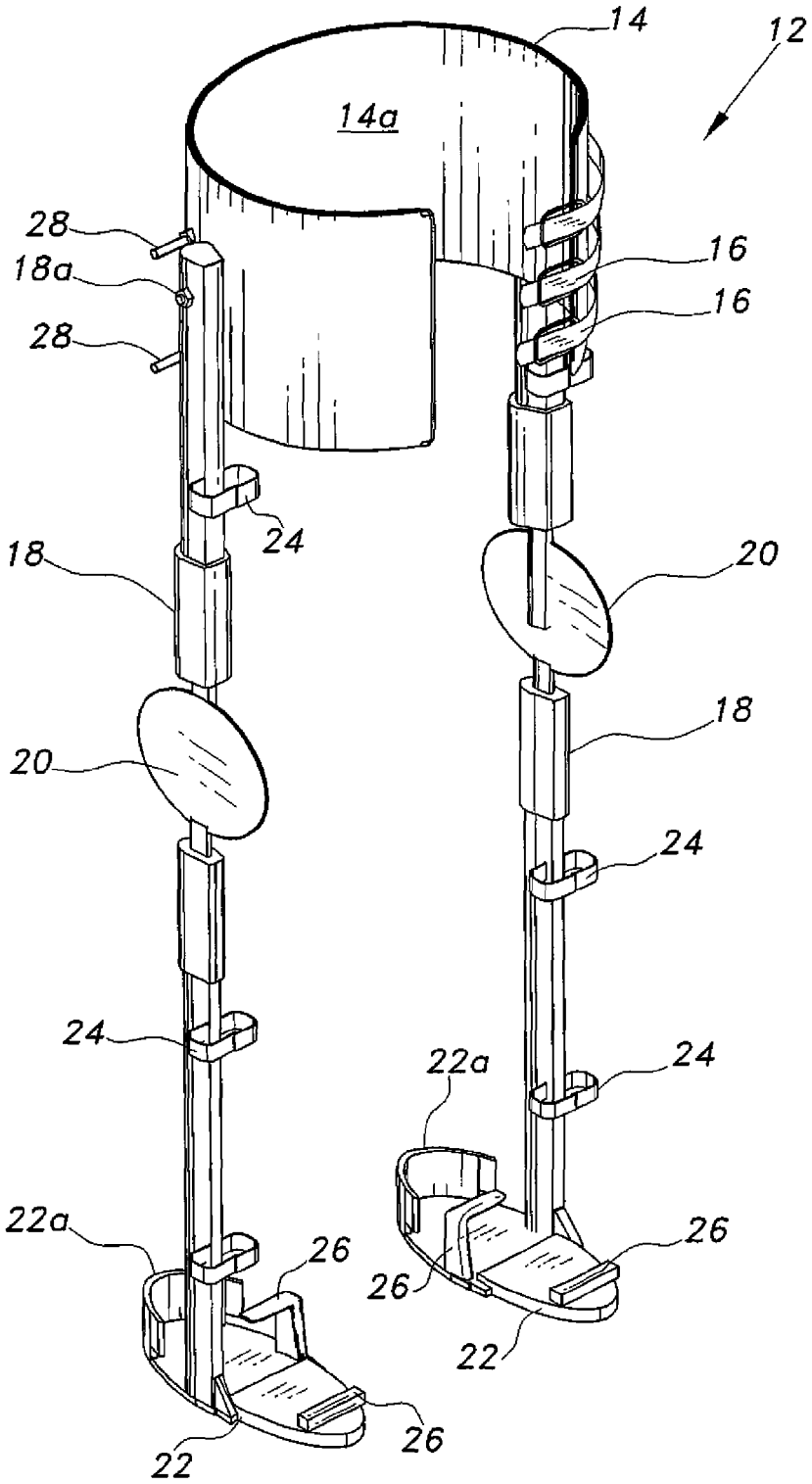
FIG. 2 is a perspective view of a body harness used in the wheeled support assembly for the disabled according to the present invention.
Figure 3:
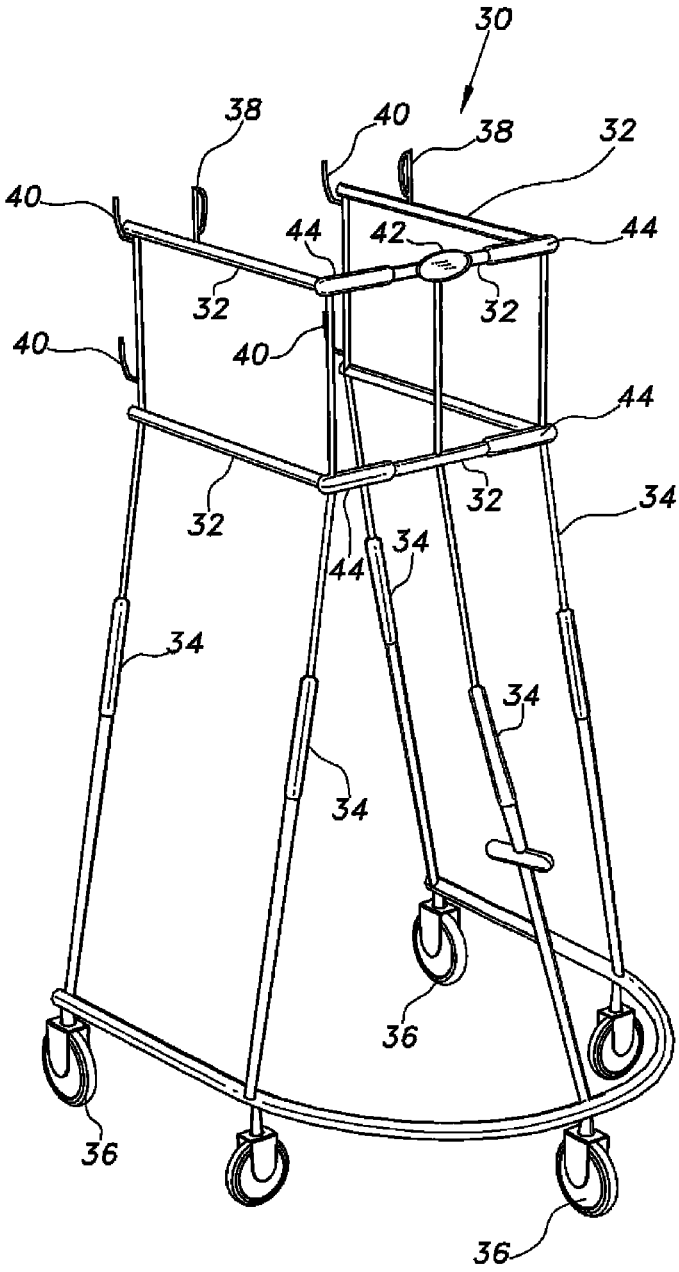
FIG. 3 is a perspective view of the mobile frame of a wheeled support assembly for the disabled according to the present invention Similar reference characters denote corresponding features consistently throughout the attached drawings.

Referring to FIGS. 1-3, the wheeled support assembly for the disabled is an assembly generally indicated at 10 and, as noted above, is designed to provide support for a disabled person P (shown in phantom lines). The assembly comprises a body harness member 12 and a wheeled support member 30 whose functions will be explained below.

As best seen in FIG. 2, the body harness member 12 includes a torso harness 14 adapted to encase the waist and lower back of the person P. The torso harness 14 is fabricated from a suitable semi-rigid material (leather, light-weight metal, plastic, rubber, etc.) that has the ability to provide support for the abdomen and spine of the disabled person. The inner surface of the torso harness 14 may be padded at 14*a* to insure comfort. Adjustable fasteners 16 (hook and loop, buttons, buckled straps, magnetic straps, etc.) are provided to secure the torso harness 14 to the torso of the person P. Respective elongate columns 18 have upper ends pivotally attached at 18*a* to the outer surface of the torso harness 14. Each column 18 terminates, at its lower end, in a foot-supporting member 22. Respective articulation members 20 are interposed approximately midway the length of each column 18. Straps 24 are mounted at spaced apart locations along the length of each column 18. Straps 26 are also provided for each foot-supporting member 22. Each foot-supporting member 22 is fashioned with a curved heel support 22*a*. Frame-engaging bolts 28 are disposed on each side of the torso harness 14.

FIG. 3 best illustrates the wheeled support frame member 30. Member 30 comprises a frame comprised of horizontal metal tubes 32 that form an enclosure open at one end. Vertically-arranged metal tubes 34 are attached at their upper ends to the horizontal tubes 32 and extend downward therefrom. The vertical tubes 34 define legs for the support member and terminate at their lower ends with wheels 36 to enhance movement of the support frame member 30. Brake levers 38 are positioned on an upper horizontal tube 32 and are connected via brake lines to at least two of the wheels 36. This arrangement allows the disabled person to control movement of the wheels 36, if necessary. Hook members 40 are arranged on the horizontal tubes 32 adjacent the open end for receiving the bolts 28 of the harness member 12 therein. A battery-operated clock and audible alarm device 42 is provided at the front of the wheeled member 30 for emergency situations. Padding 44 is strategically located on the wheeled member 30 to enhance comfort.

In use, the disabled person dons the harness member 12 utilizing straps 16, 24 and 26 to secure the harness member 12 to his/her torso, legs and feet. The person then moves into the wheeled support member 30 so that the harness bolts 28 engage hook members 40. This arrangement secures and stabilizes the person's body within the wheeled support member 30. Movement of the person's legs will propel the assembly. As contemplated, both the harness member 12 and the wheeled support member 30 will be manufactured in various sizes to accommodate persons of different sizes.

It is to be understood that the present invention is not limited to the embodiments described above, but encompasses any and all embodiments within the scope of the following claims.

I claim:

1. A support assembly for a disabled person, comprising:

a frame member having an upper end and a lower end, the frame member defining the upper end, the upper end of the frame member having a front end and a rear end, the rear end defining an opening dimensioned and configured to receive the torso of the disabled person therethrough;

a plurality of hooks disposed on the frame member adjacent only at the opening;

a plurality of wheels attached to the lower end of the frame member;

brake levers disposed on the frame member for providing a braking force to at least some of the wheels;

padding mounted on the frame member to enhance comfort;

a combination battery-operated clock and audible alarm device disposed on the frame member at the front end;

a torso harness member, the harness member being adapted to encase the waist of the disabled person, the torso harness member having an inner surface and an outer surface;

means on the harness member for adjustably securing the harness member to the waist of the disabled person;

padding disposed on the inner surface of the harness member to enhance comfort;

a plurality of bolts extending substantially horizontally from a rearward portion of the outer surface of the harness member, the bolts releasably engaging the hooks on the frame member at the opening, whereby the harness and the disabled patient are supported on the frame member the hooks at the opening only; and two elongate, articulated columns pivotally-attached to the outer surface of said harness member and extending downward therefrom; each one of said two elongate, articulated columns having an upper end and a lower end, each of the upper ends being pivotally attached to the outer surface of said torso harness member and each of the lower ends having a foot-receiving portion adapted to receive a respective foot of the disabled person.

2. The wheeled support assembly according to claim 1, wherein each of the elongate columns being adapted for attachment to a respective leg of the disabled person, each of the columns having a first plurality of spaced apart straps mounted thereon for securing a respective leg of the disabled person to the column.

3. The wheeled support assembly according to claim 2, wherein the foot-receiving portion having a second plurality straps mounted thereon adapted for securing the respective foot of the disabled person.

4. A wheeled support assembly for a disabled person, consisting of:

a frame member having an upper end and a lower end, the frame member having a front end and a rear end, the rear end defining an opening;

padding positioned on the frame member to enhance comfort;

a plurality of hooks positioned on the frame member adjacent the opening;

a plurality of wheels attached to the lower end of the frame member;

brake levers positioned on the frame member for optionally providing a braking force to at least some of the wheels;

a combination battery-operated clock and audible alarm device disposed on the frame member at the front end, the audible alarm for signaling emergency situations;

a torso harness member designed and configured to encase a waist of the disabled person, the torso harness member having an inner surface and an outer surface;

padding disposed on the inner surface of the torso harness member to enhance comfort;

a plurality of bolts extending from the outer surface, the bolts releasably engaging the hooks, whereby the torso harness and the disabled patient are supported in the frame member member;

means on the torso harness member for adjustably securing the torso harness member to the waist of the disabled person;

two respective elongate, articulated columns pivotally attached to the outer surface of the torso harness member and extending downward therefrom, each of the elongate columns being adapted for attachment to a respective leg of the disabled person;

a first plurality of spaced apart straps mounted on each of the columns for securing a respective leg of the disabled person to each column;

each the articulated column has an upper end and a lower end, each upper end being pivotally attached to the outer surface of the torso harness member and each lower end having a foot-receiving portion adapted to receive a respective foot of the disabled person; and a second plurality straps mounted on each foot-receiving portion and being adapted for securing a foot of the disabled person therein.

* * * * *